United States Patent [19]

Apitz

[11] 4,261,112

[45] Apr. 14, 1981

[54] HEAT EXCHANGE CYLINDER

[76] Inventor: Joachim Apitz, Klingenstr. 44, 7031 Leipzig, German Democratic Rep.

[21] Appl. No.: 58,324

[22] Filed: Jul. 17, 1979

Related U.S. Application Data

[63] Continuation of Ser. No. 858,383, Dec. 7, 1977, abandoned.

[30] Foreign Application Priority Data

Jan. 10, 1977 [DD] German Democratic Rep. ... 196868

[51] Int. Cl.[3] ..... F28D 11/02; F28F 5/02

[52] U.S. Cl. ..... 34/119; 34/124; 165/90; 432/228

[58] Field of Search ..... 165/90, 89; 432/60, 432/228; 219/469; 34/124, 128, 119

[56] References Cited

U.S. PATENT DOCUMENTS

| | | | |
|---|---|---|---|
| 1,837,562 | 12/1931 | Mayer | 34/124 |
| 1,914,084 | 6/1933 | Ellis et al. | 165/90 |
| 2,875,985 | 3/1959 | Hold | 165/147 |
| 3,528,493 | 9/1970 | Schultz | 432/60 |
| 3,562,489 | 2/1971 | Leak | 165/89 |
| 3,600,550 | 8/1971 | Katsumata et al. | 165/89 |
| 3,805,406 | 4/1974 | Castonoli | 165/90 |
| 3,834,205 | 9/1974 | Maag et al. | 165/90 |
| 4,090,553 | 5/1978 | Beghin | 165/89 |

FOREIGN PATENT DOCUMENTS

| | | | |
|---|---|---|---|
| 566704 | 11/1958 | Canada | 165/90 |
| 497034 | 2/1928 | Fed. Rep. of Germany | 34/119 |
| 958098 | 1/1957 | Fed. Rep. of Germany | 34/128 |

*Primary Examiner*—Sheldon J. Richter
*Attorney, Agent, or Firm*—Michael J. Striker

[57] ABSTRACT

A rotatable heat exchange drum is provided. This drum can be used for heating and/or cooling an elongated material. The drum includes an outer cylinder having an inner surface, and an inner cylinder within the outer cylinder, the inner cylinder having an outer surface annularly spaced from the inner surface of the outer cylinder so as to form an annular gap. The outer surface of the inner cylinder and/or the inner surface of the outer cylinder are/is provided with at least one channel extending therein, and being in communication with the annular gap between the inner and outer cylinders. The channel serves to provide a pathway over which heat exchange fluid is swirled in order to thereby prevent the formation of stagnant boundary or "confine" layers within the annular gap.

1 Claim, 2 Drawing Figures

HEAT EXCHANGE CYLINDER

CROSS-REFERENCE TO THE RELATED APPLICATION

This application is a continuation of application Ser. No. 858,383 filed Dec. 7, 1977, now abandoned.

BACKGROUND OF THE INVENTION

The invention relates to a heat exchange cylinder that is devised for cooling or heating and drying of continuously extending materials, such as paper, fabrics, plastic foils, plywood and the like in the course of their further elaboration or production.

German Published Application DT-AS No. 1 134 272 made known a cylinder for cooling and drying longitudinally extending materials by means of heat exchange arrangements, which cylinder is formed as a double mantle hollow cylinder, having an annular space is provided with spiral streaming paths consisting of corresponding bridging sections whose heights correspond to the height of this annular space. Through said streaming paths, the heating or cooling medium streams in opposite directions from both ends of the cylinder. Because the streaming travel of the heat exchange medium is not straight, a relatively great flow resistance (due to the collision of the oppositely directed streams); results in a decrease in the streaming speed of the medium and in lessening of the heat exchange effect. Furthermore, the heat exchange medium is caused by the centrifugal force to create on the inner mantle surface of the outer cylinder a poorly heat conductive layer, the so called confine layer, since there are absent any technical means for swirling the same. This layer influences negatively the efficiency degree of the heat discharge from the travel way of the material into the heat exchange medium or in the reversed direction. The desired effect, namely that the heat passage value be kept dependent exclusively on the streaming speed of the medium, owing hereto is not achieved in the entire intended extent.

Besides, very often, as for instance in the case of cooling of printed paper, it proves to be disadvantageous that the oppositely directed dispatching of the heat exchange medium inside the cylinder creates different temperature zones on the cylinder surface.

In addition, the German Patent DT-PS No. 861.642 disclosed a double mantle drying cylinder for heating and cooling media which cylinder has an annular space with spiral-line streaming paths being formed by bridging sections that in their heights do not fully reach the inner surface of the outer cylinder mantle. Accordingly, the heating or cooling does not evenly occur by means of a medium streaming straightly in this cylinder. Quite sure, in comparison with the above mentioned cylinder, there exists here an only insignificantly lesser streaming resistance, because the height of the bridging section diverges from (unequal to) the height of the annular gap space in so far that a small portion of the medium over the bridging sections can touch the inner surface of the outer cylinder mantle. A weak whirling formation on the bridging sections causes only an insufficient portion of the medium confine layer (having a relatively poor heat exchange capacity and formed on the inner surface by the centrifugal force) is stripped off by the medium streaming speed. The high flow hampering resistance and the consequent relatively small streaming speed do not allow achievement of optimum heat exchange.

Owing to the low streaming speed of the involved heat exchange medium, the medium tends to adopt the temperature of the cylinder wall before is has traversed through the cylinder, i.e. it is already prematurely partially or totally saturated, so that along the cylinder axis no significant high temperature differences appear on the cylinder in the direction of the medium streaming, in other words, there can not be generated any too great temperature rise.

In order to achieve at least partially the desired cooling or heating effect, the known cylinders need a great quantity of the heat exchange medium. Where the question is of a medium for heating the cylinder, there accedes hereto a high energy consumption necessarily spent on its preparation.

SUMMARY OF THE INVENTION

It is an object of the invention to provide a heat exchange cylinder, in which the relation between the investment in the basic means and the result are commensurate. It is endeavored e.g. that the volume of the heat exchange medium for cooling or heating needed during a given time period, as compared with the known technique, contemplated from the standpoint of the energy quantity necessary for preparing the respective medium and the like, be positively related to the useful effect, such as for instance in view of the temperature of the materials to be cooled on the path in case of drying. The aim is to achieve a high efficiency degree in the heat exchange capacity of the cylinder.

In consideration hereof, the object of this invention resides in abiding by the known double mantle configuration, while constructing this heat exchange cylinder in a manner such that there be obtained inside the annular gap of the cylinder a straight whirling streaming of the heat exchange medium and the centrifugal force be prevented from forming a poorly conducting medium layer on the inner surface of the outer cylinder. Thus, in comparison with the known previous technique, there will be guaranteed a great streaming speed of the medium and as an effect thereof an optimum heat exchanging transition.

According to the invention, this object is achieved in the way that there is created either on the outer surface of the mantle of the inner cylinder or on the inner surface of the outer cylinder one or a plurality of grooves, preferably configured as spiral grooves, being sharply edged in the plane of the mantle surface and that the volume of the annular gap created between the inner cylinder and the outer cylinder is smaller than the volume of the mantle of the outer cylinder. It is possible to arrange, the grooves parallel to the cylinder axis. The incipient swirling of the heat exchange medium thereby occurs by action of the cylinder revolutions. The subject matter of the invention secures a straight streaming flow of the heat exchange medium in the annular gap. In comparison to the known status of the technique, the streaming resistance against the medium is importantly lessened, in spite of the simultaneous swirling of all the layers of the medium provoked by the sharply edged spiral grooves, while in an equal relation thereto the streaming speed becomes increased. The advantageously high streaming speed gets increased according to this invention also thanks to the selection of the interrelation of the volume of the annular gap and of the outer cylinder mantle extent. This furthermore coacts in achieving that the temperature increase along the cylinder proves to have a value hardly establishable by measuring instruments and being hence negligibly low from the practical viewpoint. The total vortexing of the heat exchange medium and its high streaming speed result in an optimum heat exchange between the longitudinally extending materials and the applied medium. Here no possibility exists of any formation by action of the centrifugal force of an inactive confine layer in the medium.

On top of all of this, there is needed a small volume of the heat exchange medium, owing to the volume of the annular gap being relatively small in regard to the mentioned high efficiency degree. Being so, the temperature of the dried elongated continuous material is in case of cooling so low that it may be immediately further treated, while in case of heating the travel path of the material proves to provide drying over the entire breadth thereof.

The invention will be further clarified in the following with reference to an exemplary embodiment.

BRIEF DESCRIPTION OF THE DRAWING

The hereto related drawings show.

DETAILED DESCRIPTION OF THE PREFERRED EMBODIMENT

Figure 1:
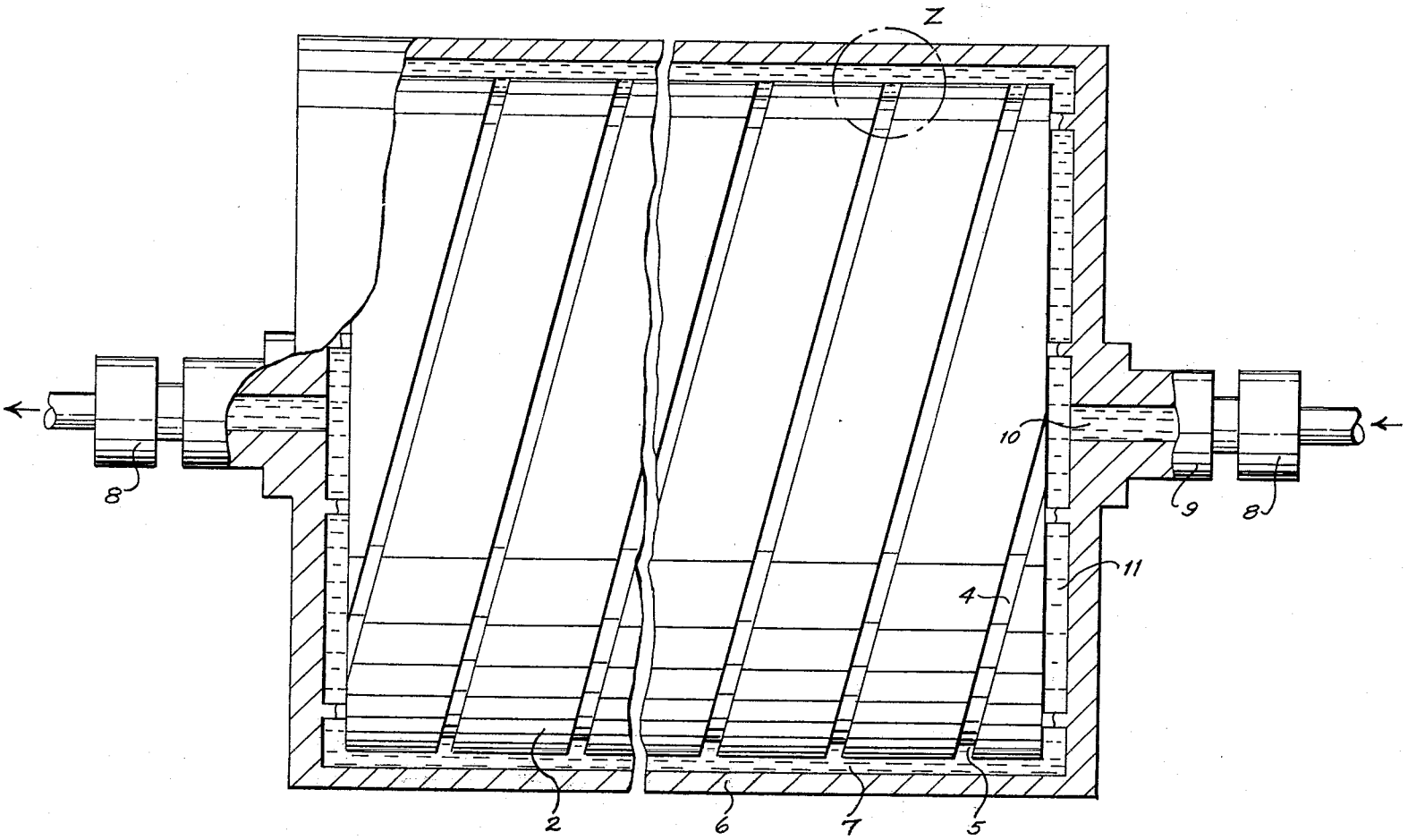
FIG. 1 a cross-sectional view of the heat exchange cylinder.
Figure 2:
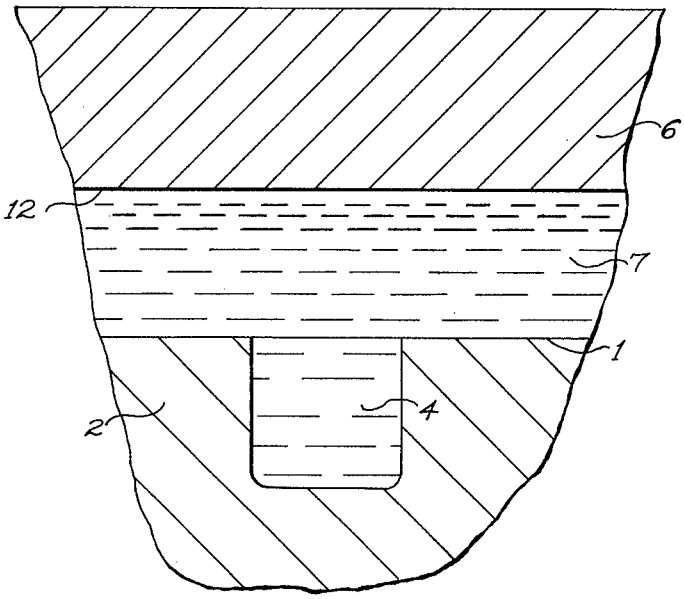
FIG. 2 the detail Z as marked in FIG. 1.

The outer mantle surface 1 of the inner cylinder 2 of the heat exchange cylinder 3 has carved thereinto a spiral groove 4 having a quadratical cross-section, which groove is configured in the plane of the mantle surface 1 with a sharp edging. For the purpose of insuring a high streaming speed of the heat exchanging medium 5, the volume of the annular gap formed between the inner cylinder 2 and the outer cylinder is smaller than the volume of the mantle of the outer cylinder 6. The feeding flow of the heat exchange medium is performed in a per-se known way via a rotation transmitter 8, an axial bore 10 passing through the axle shank 9 of the heat exchange cylinder 3 and a distribution space 11. The ascension gradient of the spiral groove 4 is measured in correspondence with the selected volume relation of the mantle of the outer cylinder 6 and the annular gap 7, i.e. with respect to the therefrom resulting streaming speed of the heat exchange medium 5, so that there is secured a sufficient vortex in the medium.

The heat exchange medium 5 flows through the rotation transmitter 8 and the axle shank 9 of the heat exchange cylinder 3 via the axial bore 10 and its streaming is accelerated by the centrifugal force of the revolving heat exchange cylinder 3 into the distribution space 11 in the annular gap 7, wherethrough it passes straightly and wherein it is swirled by the sharp edges of the spiral groove 4 in all of its layers. Thus, even when the rotation speed is very high, the build-up in the annular gap 7 of a confine layer cannot occur. In effect of this as well as of the high streaming speed of the heat exchanging medium 5, there occurs an optimum heat exchange between the continuous elongate material and the heat exchange medium 5 over the entire surface of the cylinder.

Figure 3:
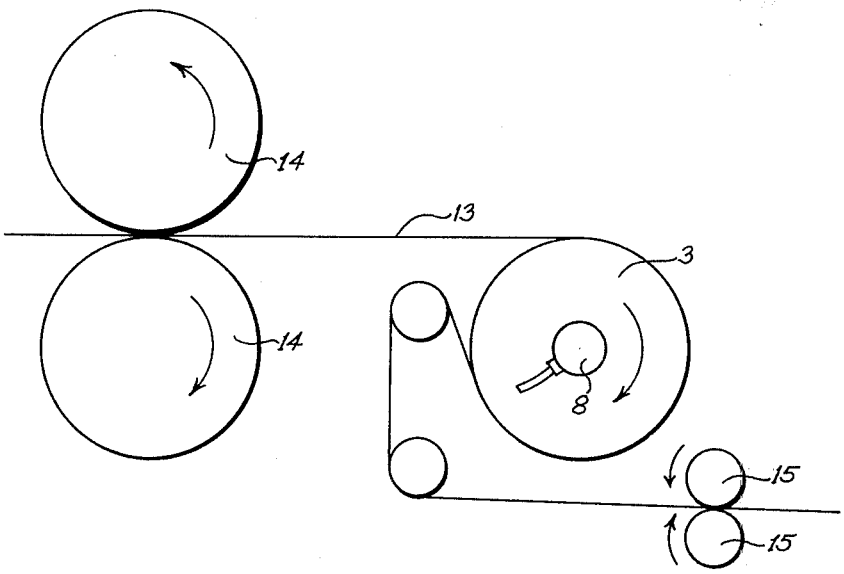
FIG. 3 shows a schematical view of a device for transporting an elongated web in combination with the heat exchange cylinder.

The elongated web of paper indicated as 13 in FIG. 3 is arranged in an advanced movement between transporting pressure rollers 14 from where the web 13 is fed onto the heat-exchange drum 3 to be cooled or heated in a heat-exchange relationship with the drum 3. A number of additional rollers 15 are provided in the arrangement to transport the material after treatment for further utilization.

I claim:

1. In combination with means transporting an elongated web of paper, or the like, along a predetermined transport path, a rotatable heat-exchange drum located along said path to exchange heat with the transported web, the drum comprising an elongated outer hollow cylinder having an inner circumferential surface, an inlet and an outlet spaced from said inlet along the elongation of said outer cylinder; an inner cylinder coaxially mounted in said outer cylinder and having an outer circumferential surface constituting with said inner circumferential surface an elongated uninterrupted gap, said outer circumferential surface being provided with at least one spiral groove extending in the direction from said inlet towards said outlet and communicating with said gap; means for introducing a heat-exchange medium through said inlet into said gap and towards said outlet of said outer cylinder; and means for rotating said outer and inner cylinders so that said groove agitates said heat exchange medium contained in said gap along the elongation thereof so as to prevent any formation of stagnant boundary layers of the heat-exchange medium in said gap.

* * * * *